United States Patent [19]

Röck et al.

[11] Patent Number: 4,536,917

[45] Date of Patent: Aug. 27, 1985

[54] FURNITURE HINGE HAVING A SPRING BIASED PIVOTING PRESSURE MEMBER

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 511,750

[22] Filed: Jul. 7, 1983

[30] Foreign Application Priority Data

Nov. 16, 1982 [AT] Austria ..... 4161/82

[51] Int. Cl.[3] ..... E05F 1/14

[52] U.S. Cl. ..... 16/288; 16/72; 16/291; 16/294; 16/296

[58] Field of Search ..... 16/50, 72, 288, 291, 16/292, 293, 294, 295, 296, 297, 302, 333, 343, 345, 370, 347

[56] References Cited

U.S. PATENT DOCUMENTS

| | | | |
|---|---|---|---|
| 4,166,307 | 9/1979 | Rock et al. | 16/288 |
| 4,310,948 | 1/1982 | Rock et al. | 16/370 |
| 4,347,644 | 9/1982 | Lautenschläger et al. . | |
| 4,349,941 | 9/1982 | Rock et al. | 16/288 |
| 4,385,417 | 5/1983 | Rock et al. | 16/288 |

FOREIGN PATENT DOCUMENTS

| | | | |
|---|---|---|---|
| 50320 | 4/1982 | European Pat. Off. | 16/288 |

*Primary Examiner*—Fred Silverberg

*Attorney, Agent, or Firm*—Wenderoth, Lind & Ponack

[57] ABSTRACT

A hinge is urged into a closed position by a spring. The hinge includes a hinge arm and a hinge casing which are linked by internal and external outer hinge links. The internal hinge link is a two armed lever and a pressure member is mounted on an end of an arm thereof extending into the hinge arm. The pressure member and a spring which acts thereon abut hinge axles which connect the hinge links to the hinge arm.

4 Claims, 1 Drawing Figure

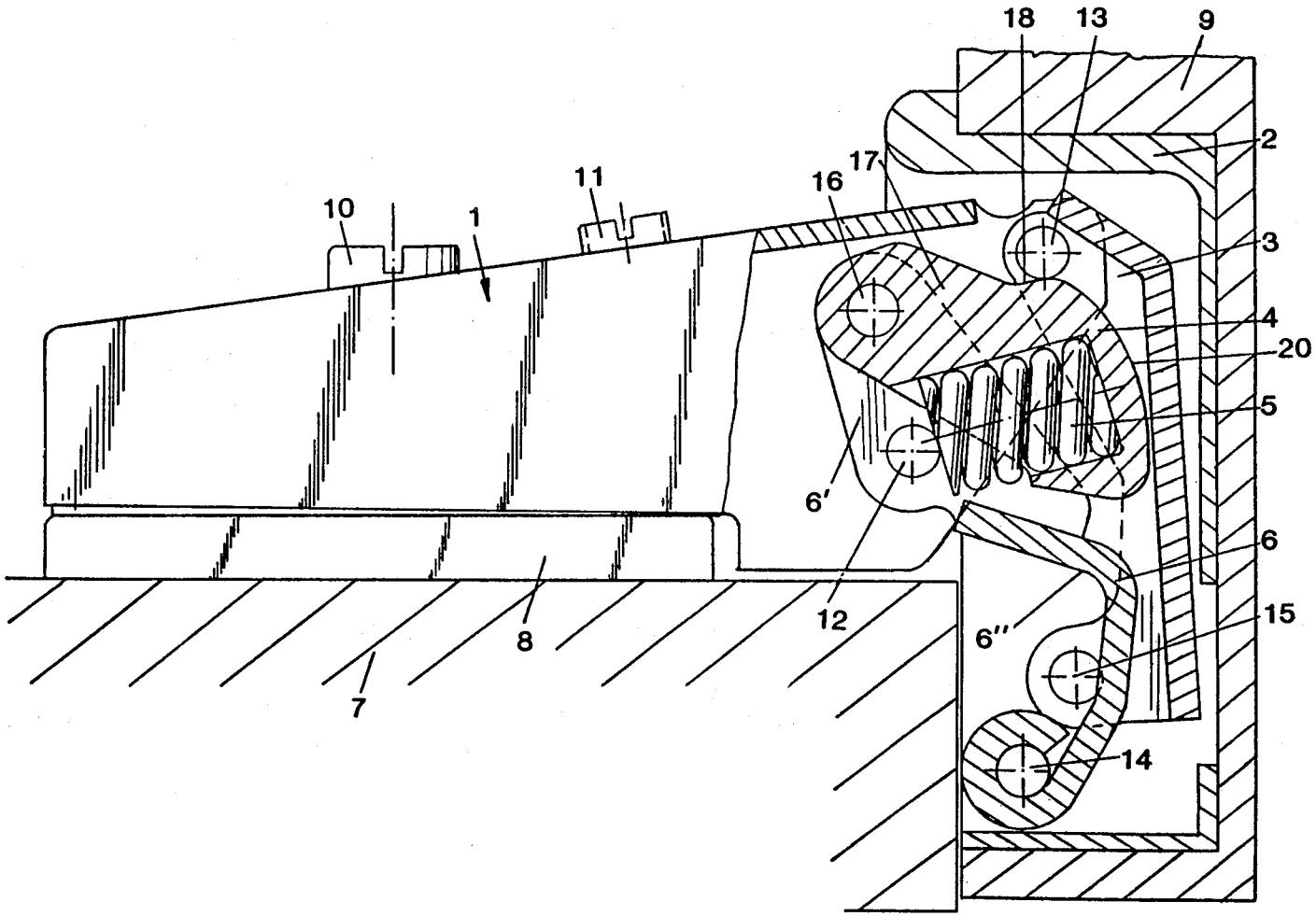
9
18
13
2
3
4
20
5
6
15
14
6''
17
16
6'
12
11
1
10
8
7

FURNITURE HINGE HAVING A SPRING BIASED PIVOTING PRESSURE MEMBER

FIELD AND BACKGROUND OF THE INVENTION

The invention relates to a hinge for an article of furniture provided with a closing mechanism. The hinge includes a hinge casing at the side of the door in which inner ends of two hinge links are pivotally mounted. The outer ends of the two hinge links are pivotally mounted on a hinge arm, thereby forming a hinge quadrangle. A pressure member, pre-stressed by spring pressure, is provided within the hinge arm and is pivotally mounted on the internal hinge link. The pressure member abuts in the closed position of the hinge against a hinge axle connecting the external hinge link to the hinge arm. A preferably convex support surface is provided on the pressure member.

DESCRIPTION OF THE PRIOR ART

Such hinges having a separate closing mechanism are well known. It is their essential advantage that a separate closing member, e.g. a magnetic catch member, is not required on the piece of furniture.

This closing mechanism generally is of a construction such that the closed door is retained closed by the hinge and that, when the door is opened, the spring pressure of the closing mechanism must be overcome and when a dead center has been passed, the door is moved outwardly by the closing mechanism, i.e. into the open position.

When the door is closed, the closing mechanism operates vice versa in an analogous manner.

It is the main disadvantages of such hinges that the closing effect of the hinge substantially starts when the door is in a 45°-open position. That is, the door is closed relatively early, namely at a time when the actual effect of the hinge and of the closing mechanism is not yet desired. Moreover, the doors of the piece of furniture are often banged due to the long effective closing path, thus causing undesired noise and, furthermore, creating disadvantages with respect to the high stresses acting on the axles and links of the hinge.

SUMMARY OF THE INVENTION

It is the object of the invention to provide a hinge of the afore-mentioned type wherein the angle of the furniture door to the actual closing plane of the furniture door at which the closing effect occurs can be freely selected and can be relatively small, preferably an angle of between 10° and 15°. Hence, neither when opening nor when closing the door, need a dead center of the hinge be overcome. Furthermore, the closing mechanism of the hinge according to the invention is accomodated in the hinge arm in a very compact manner.

According to the invention this is achieved in that the pressure member and its pressure spring constantly abut against the two hinge axles of the hinge arm in the open as well as in the closed position of the hinge arm.

An embodiment of the invention provides that one arm of the internal hinge link extends into the hinge arm and that the pressure member is hingedly connected with such arm. The hinge axles of the hinge arm and the point at which the pressure member is hingedly connected with such one arm of the internal hinge link define a substantially isosceles triangle in the closed position of the hinge.

A further embodiment provides that in the closed position of the hinge a straight line which extends through both hinge axles of the hinge arm extends at an angle of between 30° and 50 °, preferably of 41°, to the longitudinal center axis, of the pressure spring which is designed as a coil spring.

BRIEF DESCRIPTION OF THE DRAWING

In the following an embodiment of the invention will be described in more detail with reference to the accompanying drawing which is a sectional view of a hinge according to the invention and shown in the closed position.

DESCRIPTION OF THE PREFERRED EMBODIMENT

As can be seen from the drawing, the hinge according to the invention comprises a hinge arm 1 fastened to a furniture side wall 7 by means of a base plate 8. The base plate 8 is fastened to the furniture side wall 7 in a conventional manner by means of screws or dowels. The hinge arm 1 is retained on the base plate 8 by means of a clamping screw 10. An adjusting screw 11 for adjustment of the joint of the door is also provided on the hinge, the adjusting screw being mounted in a female thread in the hinge arm 1 and abutting against the base plate 8.

A hinge casing 2 of a recess in hinge is inserted into the door 9.

The hinge arm 1 is connected with the hinge casing 2 by means of external and internal hinge links 3, 6 mounted on respective hinge axles 13, 12 on the hinge arm 1 and on respective hinge axles 15, 14 on the hinge casing 2.

The internal hinge link 6 is a two-arm lever, including first and second arms 6″, 6′, pivoting around the hinge axle 12 of the hinge arm 1. At the free end of second arm 6′ of the hinge link, i.e. at a position spaced from hinge axles 12, 14 toward hinge arm 1, and mounted on a bolt or axle 16 is a pressure member 4 having a holding arm 17. The pressure member 4 is pivotable around the bolt 16, but the pivoting motion of the pressure member 4 is limited in one direction by the hinge link axle 13 and in the other direction by the hinge link axle 12.

The pressure member 4 has a recess receiving a pressure spring 5 abutting against the internal hinge link axle 12.

The pressure member 4 according to the invention abuts in the closed position of the door 9, as illustrated in the drawing, with its pressure surface 18 against the hinge link axle 13 and presses the internal hinge link 6 into the closing direction, i.e. the door 9 is held in the closed position.

When the door is opened or is moving in the opening direction, a pressure surface 20 of the pressure member 4 moves on the hinge axle 13 but no load is applied by the pressure spring, i.e. the pressure member 4 and the pressure spring 5 are equally tensioned.

When the door 9 is closed, the surface 20 of pressure member 4 moves along the hinge axle 13, but the tensioning condition of the pressure spring 5 is not changed. That is, with the hinge according to the invention, the pressure spring is not under tension either when closing nor when opening the hinge, and thus banging on the door 9 will not occur. There is no dead center which must be overcome, but nevertheless the door 9 is absolutely securely held in the closed position by the pressure spring 5.

The curve of the pressure surfaceses 18,20 of the pressure member 4 can obviously be selected such that the door 9 is closed at a desired angle, e.g. 10°, to the closing plane.

What is claimed is:

1. A hinge comprising:

a hinge arm adapted to be mounted on an article of furniture and having first and second hinge axles;

a hinge casing adapted to be mounted on a door of the article of furniture and having third and fourth hinge axles;

an internal hinge link in the form of a two-arm lever including a first arm having first and second ends pivotally mounted on said first and third hinge axles, respectively, and a second arm extending from said first hinge axle into said hinge arm;

an external hinge link having first and second ends pivotally mounted on said second and fourth hinge axles, respectively;

a pressure member pivotally mounted directly to said second arm of said internal hinge link on a seperate pivot at a position spaced toward said hinge arm and spaced from said first and second hinge axles, said pressure member having a contact surface;

spring means for continuously abutting said first hinge axle and for urging said pressure member to pivot about said separate pivot to maintain said contact surface in direct abutment with said second hinge axle throughout both the open and closed positions of the hinge; and said pressure member always extending from said position spaced from said first and second hinge axles in a direction between said first and second hinge axles and toward said hinge casing to a position between the second and fourth hinge axles, and wherein said pressure member is adjacent said hinge casing in the closed position.

2. A hinge as claimed in claim 1, wherein said first and second hinge axles and said position define a substantially isosceles triangle in the closed position of the hinge.

3. A hinge as claimed in claim 1, wherein said spring means comprises a coil spring compressed between said first hinge axle and said pressure member in an orientation such that in the closed position of the hinge a straight line extending between said first and second hinge angles is inclined with respect to a center axis of said coil spring at an angle of between 30° and 50°.

4. A hinge as claimed in claim 3, wherein said angle is 41°.

* * * * *